US008794374B2

(12) United States Patent
Kim et al.

(10) Patent No.: US 8,794,374 B2
(45) Date of Patent: Aug. 5, 2014

(54) ACOUSTIC TRANSDUCER DEVICE

(75) Inventors: Ji Hoon Kim, Gyeongsangnam-do (KR); Kwan Ho Ko, Busan (KR); Joong Hak Kwon, Gyeonsangbuk-do (KR)

(73) Assignee: EM-Tech. Co., Ltd., Busan (KR)

( * ) Notice: Subject to any disclaimer, the term of this patent is extended or adjusted under 35 U.S.C. 154(b) by 0 days.

(21) Appl. No.: 13/635,176

(22) PCT Filed: Jul. 25, 2011

(86) PCT No.: PCT/KR2011/005462

§ 371 (c)(1),
(2), (4) Date: Nov. 27, 2012

(87) PCT Pub. No.: WO2012/023709

PCT Pub. Date: Feb. 23, 2012

(65) Prior Publication Data

US 2013/0133975 A1 May 30, 2013

(30) Foreign Application Priority Data

Aug. 18, 2010 (KR) ..... 10-2010-0079787

(51) Int. Cl.

| | |
|---|---|
| ***G10K 13/00*** | (2006.01) |
| ***H04R 1/00*** | (2006.01) |
| ***H04R 7/00*** | (2006.01) |
| ***H04R 9/06*** | (2006.01) |

(52) U.S. Cl.
USPC ..... 181/166; 181/164; 181/171; 381/398; 381/412

(58) Field of Classification Search
USPC ..... 181/166; 381/398, 412, 150
See application file for complete search history.

(56) References Cited

U.S. PATENT DOCUMENTS

| | | | | |
|---|---|---|---|---|
| 6,490,363 | B1 * | 12/2002 | Liu | 381/403 |
| 7,088,842 | B2 * | 8/2006 | Hikichi | 381/430 |
| 7,184,567 | B2 * | 2/2007 | Sugata et al. | 381/433 |
| 7,505,603 | B2 | 3/2009 | Yoo | |
| 2002/0054691 | A1 * | 5/2002 | Miyamoto et al. | 381/409 |
| 2004/0170297 | A1 * | 9/2004 | Hikichi | 381/430 |
| 2004/0240702 | A1 * | 12/2004 | Kaiwa et al. | 381/423 |
| 2006/0098838 | A1 * | 5/2006 | Yoo | 381/398 |
| 2006/0177091 | A1 * | 8/2006 | Funahashi | 381/412 |
| 2008/0166010 | A1 * | 7/2008 | Stiles et al. | 381/423 |
| 2011/0228949 | A1 * | 9/2011 | Haba et al. | 381/86 |
| 2012/0114166 | A1 * | 5/2012 | Sano et al. | 381/413 |

FOREIGN PATENT DOCUMENTS

| | | | |
|---|---|---|---|
| JP | 09-307993 | 11/1997 | |
| JP | 09307993 A * | 11/1997 | H04R 9/02 |
| JP | 2001-211499 | 8/2001 | |

(Continued)

OTHER PUBLICATIONS

International Preliminary Report on Patentability for PCT/KR2011/005462 (Feb. 19, 2013).

(Continued)

*Primary Examiner* — David Warren
*Assistant Examiner* — Christina Russell
(74) *Attorney, Agent, or Firm* — Murphy, Bilak & Homiller, PLLC

(57) ABSTRACT

The present invention relates to a sound converter, and, more particularly, to a sound converter which can solve a problem in that a vibration space decreases in the sound converter requiring high outputs, as the overall height of a voice coil increases.

16 Claims, 5 Drawing Sheets

(56) References Cited

FOREIGN PATENT DOCUMENTS

| | | |
|---|---|---|
| JP | 2003-001191 | 1/2003 |
| JP | 2004-260736 | 9/2004 |
| KR | 20-0298314 | 12/2002 |
| KR | 10-0419914 | 2/2004 |
| KR | 10-0930537 | 12/2009 |
| WO | 2010/044623 | 4/2010 |
| WO | 2010/050068 | 5/2010 |
| WO | WO 2010150942 A1 * | 12/2010 |

OTHER PUBLICATIONS

Extended European Search Report for European Application 11818309.4 (Apr. 3, 2013).
International Search Report for International Application PCT/KR2011/005462 (Feb. 10, 2012).
Office Action issued in corresponding Chinese Application No. 201180004402.3 (Jan. 15, 2014).

* cited by examiner

ACOUSTIC TRANSDUCER DEVICE

TECHNICAL FIELD

The present invention relates to a sound converter, and, more particularly, to a sound converter which can solve a problem in that a vibration space decreases in the sound converter requiring high outputs, as the overall height of a voice coil increases.

BACKGROUND ART

In general, a sound converter is used as a concept including a speaker, etc. The speaker converts electrical energy into mechanical energy through a voice coil present in a void according to Fleming's left hand rule to thereby generate sound.

That is, when a current signal containing various frequencies is applied to the voice coil, the voice coil produces mechanical energy according to the intensity of the current and the magnitude of the frequency, causes vibration to a diaphragm attached to the voice coil, and ultimately generates a given magnitude of sound pressure which can be recognized by human ears.

A magnetic circuit of the speaker is designed in a yoke made of a ferrous metal element so that a magnetic flux can be interlinked perpendicularly to the voice coil present in the void by using a magnet (permanent magnet) and a top plate (or upper plate). The voice coil is adhered to the diaphragm to generate an electromotive force in the vertical direction according to an input signal, which vibrates the diaphragm adhered to and constrained by a frame to generate sound pressure.

The diaphragm is provided with various forms of waves to attain an excellent response and prevent a buckling phenomenon during the vertical vibration. The shape of the diaphragm is a factor which has the most significant effect on frequency characteristics.

FIG. 1 is a sectional view of a conventional sound converter.

As illustrated in FIG. 1, the typical sound converter includes a frame 1, a yoke 2 inserted into and mounted in the frame 1, an inner ring magnet 3 and an outer ring magnet 4 transferring the magnetic flux to the yoke 2 or receiving the magnetic flux from the yoke 2, an inner ring top plate 5 and an outer ring top plate 6 receiving the magnetic flux from the inner ring magnet 3 or the outer ring magnet 4 and transferring the magnetic flux perpendicularly to a voice coil 7, the voice coil 7 partially inserted into a void between the inner ring magnet 3 and the inner ring top plate 5 and the outer ring magnet 4 and the outer ring top plate 6, a diaphragm 8 having the voice coil 7 attached thereto to generate vibration according to the vertical motion of the voice coil 7, and a protector 10 having a sound emission hole 11 and protecting the diaphragm 8.

Additionally, a lead-out wire of the voice coil 7 is fixedly attached to the bottom surface of the diaphragm 8 by a bond, taken out through the lateral surface of the frame 1 or through a groove (not shown) formed in the frame 1, and soldered to a terminal 14 along the outer lateral surface of the frame 1.

In the conventional sound converter described above, an electric wire forming the voice coil 7 is made of a thick material so as to increase outputs, which increases the overall height of the voice coil 7. Accordingly, a space below the voice coil 7 should be so large that the voice coil 7 can be vibrated in the vertical direction to cause vibration to the diaphragm 8. To this end, if the voice coil 7 is made of a thick material to increase outputs, it needs to be positioned higher. For this, a seating portion of the diaphragm 8 should also be positioned higher. As a result, if the entire size of the sound converter does not increase, there is no sufficient vibration space for the upward dome-shaped diaphragm 8.

Moreover, even if the wire material of the coil is not thickened on account of mid frequency efficiency characteristics by weight, the amplitude of the diaphragm increases in a high-output mode, which requires efficient space utilization. Once the vibration space is obtained, the magnetic circuit space decreases, which degrades characteristics.

In another case, an aluminum alloy coil having a small specific gravity is used to improve mid frequency efficiency characteristics by its weight. This coil is often broken due to low strength, which results in low reliability.

DISCLOSURE OF THE INVENTION

An object of the present invention is to provide a sound converter which can solve a problem in that a vibration space decreases, as the overall height of a voice coil increases, said voice coil having a large wire diameter to increase outputs of the sound converter.

Another object of the present invention is to provide a structure for efficiently utilizing a vibration space without decreasing the size of a magnetic circuit to ensure a sufficient vibration space in high outputs.

A further object of the present invention is to provide a sound converter which includes a damper for preventing biased vibration from occurring, when outputs of the sound converter increase, said damper having a conductive pattern formed thereon, such as flexible printed circuit board (FPCB), to arrange a leader wire withdrawal structure of a voice coil.

A still further object of the present invention is to provide a sound converter which includes a damper with a conductive pattern formed thereon, such as FPCB, said damper being taken out of the frame and serving as a terminal brought into contact with an external connection terminal.

A still further object of the present invention is to provide a sound converter which includes a diaphragm made of a laminate of different materials to improve rigidity and reliability.

According to an aspect of the present invention, there is provided a sound converter including: a frame; a yoke assembly provided on one side of the frame and provided with a magnet; a diaphragm provided in the frame to generate vibration; a protector provided over the diaphragm, coupled to the frame, and protecting the diaphragm; a damper having a central portion formed at the center in a certain shape, a seating portion spaced apart from the central portion and seated on the frame, and a connection portion elastically connecting the seating portion to the central portion; a side diaphragm having an inner circumference portion overlapping with the edge of the central portion of the damper and an outer circumference portion overlapping with the seating portion and seated on the frame, said diaphragm being formed in a dome shape having a central portion more projecting than the inner circumference portion and the outer circumference portion; and a voice coil mounted on the overlapping portion of the inner circumference portion of the side diaphragm and the central portion of the damper, wherein the projecting direction of the dome shape of the side diaphragm is the mounting direction of the voice coil.

In addition, the sound converter may further include a center diaphragm attached to an upper part of the central portion of the damper.

Moreover, the center diaphragm may project to the lower side or the upper side.

Additionally, the damper may have a conductive pattern formed thereon.

Further, the damper with the conductive pattern formed thereon may be an FPCB.

Furthermore, a soldering or welding portion may be provided at the central portion of the damper to connect a leader wire of the voice coil.

Still furthermore, the soldering or welding portion may be positioned at the connection portion of the damper.

Still furthermore, the damper may include a terminal portion extending from one side of the seating portion, exposed to the outside of the frame, and providing an electrical connection with an external connection terminal.

Still furthermore, the soldering or welding portion may be positioned on the inside of a voice coil attachment portion.

Still furthermore, the extended portion of the damper may be bent along the lateral surface of the frame and attached to the bottom surface of the frame.

Still furthermore, a groove may be formed in the frame to guide the extended portion of the damper.

Still furthermore, a projection may be formed on the lateral surface of the frame to thermally bond a part of the damper.

Still furthermore, a groove may be formed in the extended portion of the damper that corresponds to the thermal bonding projection of the frame.

Still furthermore, the side diaphragm is prepared by laminating a thermoplastic polyurethane (TPU) film and a polyetheretherketone (PEEK) film.

Still furthermore, the voice coil may be a lightweight aluminum alloy coil.

Accordingly, in the sound converter provided by the present invention, since there is a sufficient vibration space, it can be designed to improve sound pressure in low frequency bands of large vibration displacement.

In addition, in the sound converter provided by the present invention, since the lead-in wire of the voice coil is not connected directly to the outside, the aluminum-copper alloy coil having low strength can be employed without disconnection.

Moreover, if outputs increase, biased vibration may occur. In the sound converter provided by the present invention, the damper with the conductive pattern formed thereon, such as FPCB, is used to prevent biased vibration, arrange the leader wire withdrawal structure of the voice coil, and prevent cutting of the leader wire connected to the terminal in high outputs, which reduces the defection rate.

Additionally, in the sound converter provided by the present invention, the damper with the conductive pattern formed thereon, such as FPCB, is taken out of the frame and serves as a terminal brought into contact with the external connection terminal, which simplifies the assembly and cuts down the material costs.

Further, in the sound converter provided by the present invention, the diaphragm is made of a laminate of different materials to improve rigidity and reliability.

Furthermore, in the sound converter provided by the present invention, since the vibration space can be larger, sound pressure in low frequency bands, which require a large vibration space, can be increased to improve sound characteristics.

BEST MODE FOR CARRYING OUT THE INVENTION

Figure 1:
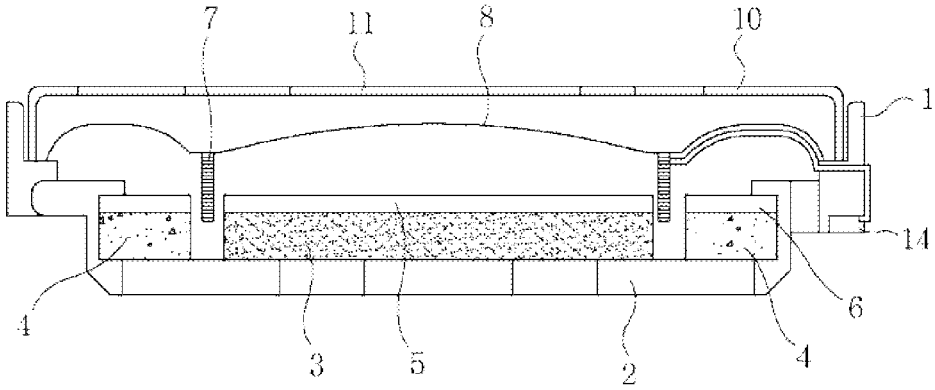
FIG. 1 (PRIOR ART)
FIG. 1 is a view of a conventional sound converter.
Figure 2:
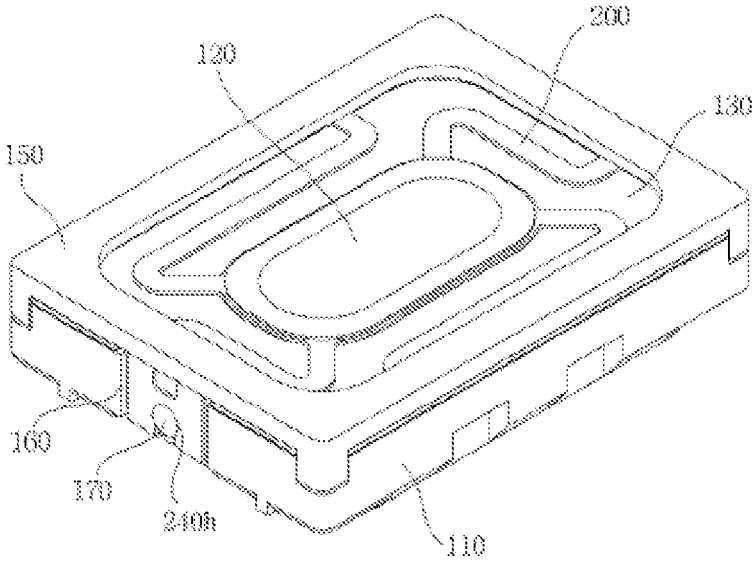
FIG. 2 is a perspective view of a sound converter according to a first embodiment of the present invention.
Figure 3:
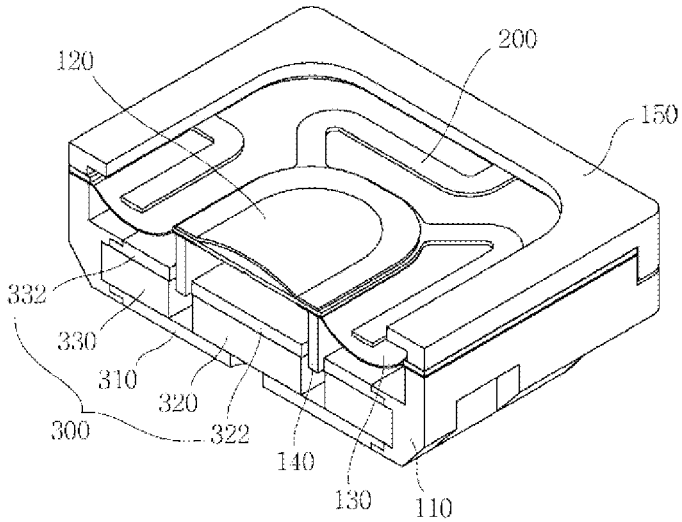
FIG. 3 is a cut-away perspective view of the sound converter according to the first embodiment of the present invention.

FIG. 2 is a perspective view of a sound converter according to a first embodiment of the present invention, and FIG. 3 is a cut-away perspective view of the sound converter according to the first embodiment of the present invention. In the sound converter according to the first embodiment of the present invention, a yoke assembly 300, in which an inner ring magnet 320 and an outer ring magnet 330 are attached to a yoke plate 310, is coupled to a frame 110, then a damper 200, a center diaphragm 120 and a side diaphragm 130 are provided so that a voice coil 140 attached to the damper 200 can be positioned in a gap between the inner ring magnet 320 and the outer ring magnet 330. An inner ring top plate 322 and an outer ring top plate 332 are respectively attached to the inner ring magnet 320 and the outer ring magnet 330. Next, a protector 150 is provided to protect the diaphragms 120 and 130. As can be seen in FIG. 3, a dome portion of the side diaphragm 130 projects to the bottom surface of the damper 200, i.e., in the mounting direction of the voice coil 140. Therefore, in the case of the voice coil 140 made of an electric wire having a large diameter to obtain high outputs, as the height of the voice coil 140 increases, the installation position of the voice coil 140 should be set higher so that it does not touch the yoke plate 310. Typically, the sound converter has a given limited height, which restricts the height of the upward dome portion of the side diaphragm 140. However, the dome portion of the side diaphragm 130 according to the present invention projects to the bottom surface where the voice coil is installed, thus having a sufficient space for projection.

Additionally, the side diaphragm 130 according to the present invention is prepared by laminating a polyetheretherketone (PEEK) film and a thermoplastic polyurethane (TPU) film. The thickness of the side diaphragm 130 should be decreased to improve low frequency band characteristics of the sound converter. The thinner the diaphragm, the more defects may occur during the manufacture. To solve this problem, the TPU element, which does not affect the rigidity of the diaphragm, i.e., the sound characteristics, is laminated with the PEEK element, which maintains rigidity and increases thickness. As a result, reliability of the diaphragm can be improved. Moreover, the TPU film has an advantage in that it increases a damping ratio to improve dynamic characteristics of the sound.

Further, it is preferable that the voice coil 140 should be a lightweight aluminum alloy coil. The more the weight of the voice coil 140 decreases, the more the amplitude of the diaphragm 130 increases, resulting in high sound outputs.

Figure 4:
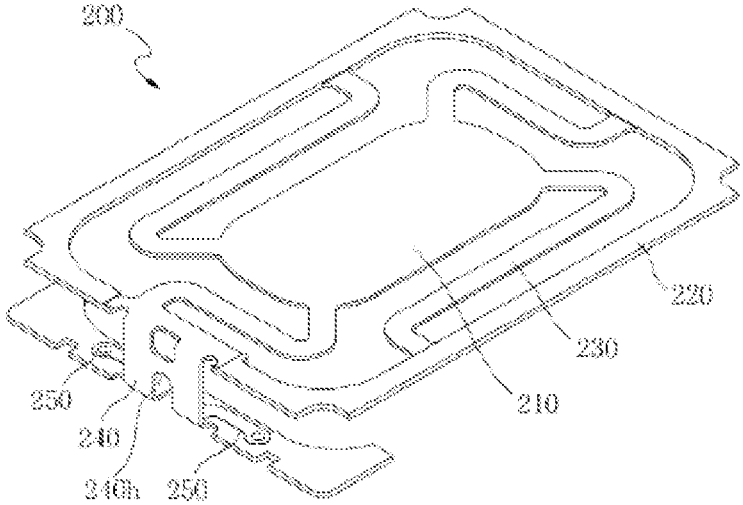
FIG. 4 is a perspective view of a damper provided in the sound converter according to the first embodiment of the present invention, when viewed from the top.
Figure 5:
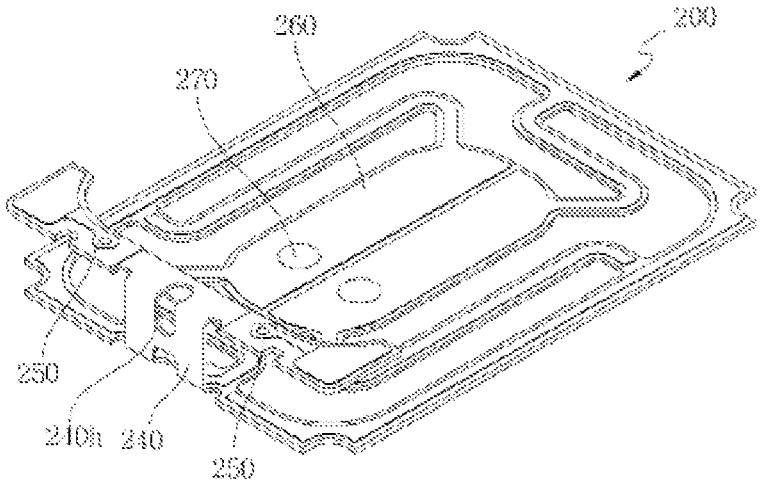
FIG. 5 is a perspective view of the damper provided in the sound converter according to the first embodiment of the present invention, when viewed from the bottom.
Figure 6:
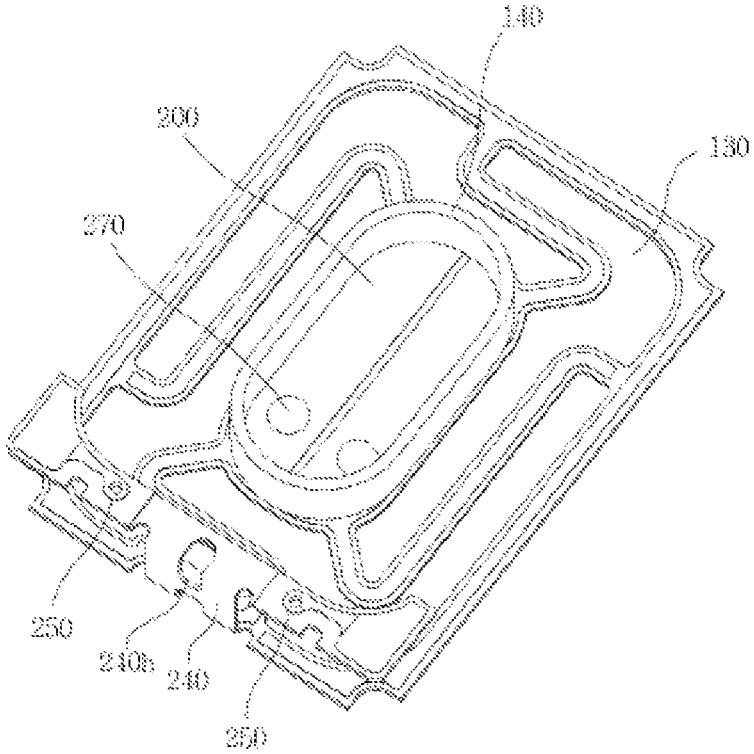
FIG. 6 is a perspective view showing a state where a voice coil is mounted under the damper provided in the sound converter according to the first embodiment of the present invention.

FIG. 4 is a perspective view of a damper provided in the sound converter according to the first embodiment of the present invention, when viewed from the top, FIG. 5 is a perspective view of the damper provided in the sound converter according to the first embodiment of the present invention, when viewed from the bottom, and FIG. 6 is a perspective view showing a state where a voice coil is mounted under the damper provided in the sound converter according to the first embodiment of the present invention. The damper 200 provided in the sound converter according to the first embodiment of the present invention includes a central portion 210 formed at the center in a certain shape, a seating portion 220 spaced apart from the central portion 210 and seated on the frame 110, and a connection portion 230 elastically connecting the seating portion 220 to the central portion 210. The central portion 210 of the damper 200 can serve as the center diaphragm 120, so that the center diaphragm 120 is not necessary. In this case, the weight of the central portion 210 serving as the center diaphragm 120 is smaller than that of the central portion 210 provided with the center diaphragm 120, which can improve mid and high frequency band sound characteristics. Meanwhile, in a case where the center diaphragm 120 is separately manufactured and attached to the central portion 210, the center diaphragm 120 may be formed in an upward dome shape and attached to the upper part of the central portion 210 of the damper 200, or the center diaphragm 120 may be formed in a downward dome shape and attached to the lower part of the central portion 210 of the damper 200. On the other hand, the connection portion 230 aids the central portion 210 to perform only the vertical motion by the vibration of the voice coil 140, thereby preventing split vibration and improving mid and high frequency band sound characteristics. Parts of the connection portion 230, which are connected directly to the central portion 210 and the seating portion 220, are perpendicular thereto and have a relatively small length, so that the central portion 210 can perform only the vertical motion. A part between the parts connected perpendicularly to the central portion 210 and the seating portion 220 is in parallel thereto and have a relatively large length. However, it is to be noted that the shape of the connection portion 230 of the damper 200 is not necessarily connected perpendicularly to the central portion 210 and the seating portion 220 and is not necessarily in parallel to the central portion 210 and the seating portion 220. It is preferable that the connection portion 230 should be relatively long to lower rigidity in the vertical direction and should have a symmetric structure to eliminate biased vibration in the lateral direction.

A conductive pattern 260 may be formed on the bottom surface of the damper 200, i.e., the mounting surface of the voice coil 140. In addition, a soldering or welding portion 270 for electrically connecting a leader wire of the voice coil 140 to the conductive pattern 260 is provided at the central portion 210. The leader wire of the voice coil 140 is electrically connected to the soldering or welding portion 270 by means of soldering or welding. As an example of the damper 200 with the conductive pattern 260 formed thereon, the damper 200 itself may be an FPCB with an electric transfer structure pattern. The use of the conductive pattern 260 removes the necessity of taking the leader wire of the voice coil 140 out of the frame 110 and connecting it to a terminal. Furthermore, as the leader wire is extended to the frame, it is possible to prevent the leader wire from being broken by vibration of the diaphragms 120 and 130 and the damper 200 caused by the voice coil 140.

In the meantime, the damper 200 with the conductive pattern 260 formed thereon includes an extended portion having one end exposed to the outside of the frame 110. The extended portion includes a bonding portion 240 bent on one side of the seating portion 220 to surround the lateral surface of the frame 110 and a terminal portion 250 providing an electrical contact with an external connection terminal. Therefore, the conductive pattern is connected between the welding portion 270 and the terminal portion 250, so the damper 200 provides an electrical connection between the external connection terminal and the voice coil 140 without using a special structure. A groove 160 is formed in the frame 110 to guide the bonding portion 240. In addition, the bonding portion 240 is thermally bonded to the frame 110 to secure the terminal portion 250. The frame 110 has a projection 170 to thermally bond the bonding portion 240, and the bonding portion 240 has a hole 240*h* into which the projection 170 for thermal bonding is to be inserted. Moreover, the terminal portion 250 and the frame 110 have a groove and a projection corresponding to each other in shape, respectively.

Figure 7:
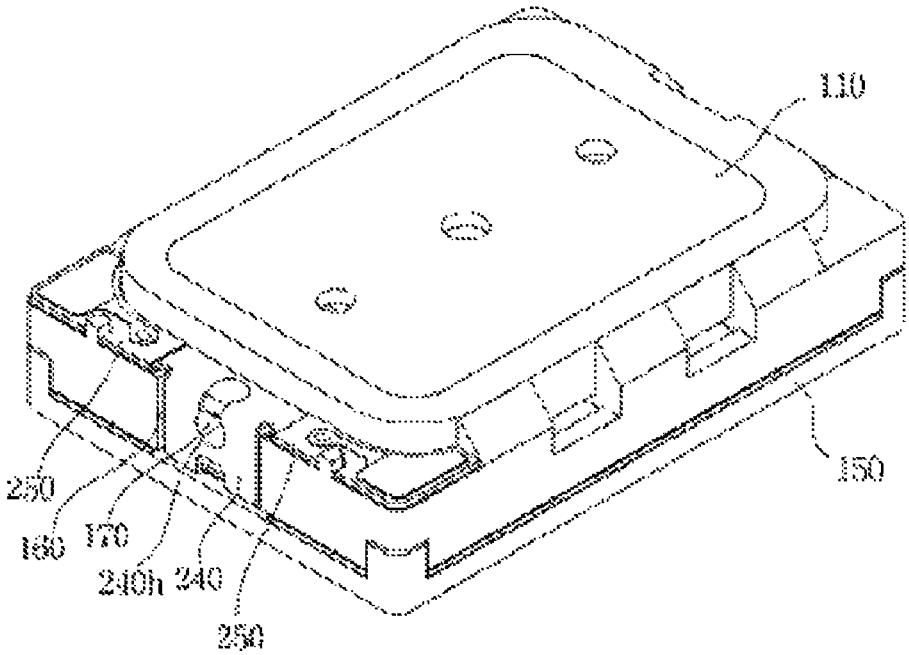
FIG. 7 is a perspective view of a sound converter according to a second embodiment of the present invention, when viewed from the bottom.

FIG. 7 is a perspective view of a sound converter according to a second embodiment of the present invention, when viewed from the bottom. A bonding portion 240 and a terminal portion 250 of a damper 200 are exposed to lateral and bottom surfaces of a frame 110, so that the terminal portion 250 can be connected to an external connection terminal. This also facilitates the bonding of the bonding portion 240 and the fixing of the terminal portion 250.

Figure 8:
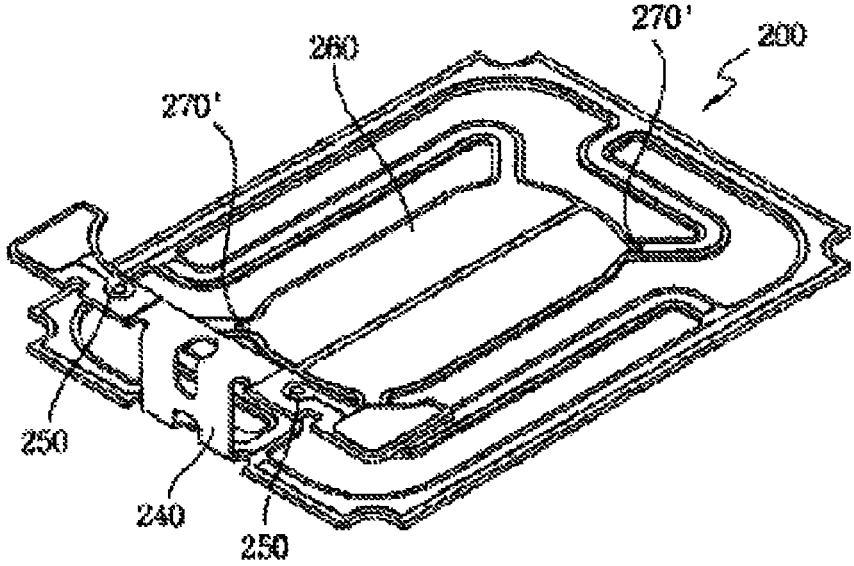
FIG. 8 is a perspective view of a damper provided in the sound converter according to the second embodiment of the present invention, when viewed from the bottom.

FIG. 8 is a perspective view of a damper provided in the sound converter according to the second embodiment of the present invention, when viewed from the bottom. The damper 200 provided in the sound converter according to the second embodiment of the present invention includes a central portion 210 formed at the center in a certain shape, a seating portion 220 spaced apart from the central portion 210 and seated on the frame 110, and a connection portion 230 elastically connecting the seating portion 220 to the central portion 210. The bonding portion 240, the terminal portion 250 and the conductive pattern 260 of the damper 200 are identical to those of the damper 200 provided in the sound converter according to the first embodiment of the present invention. In the damper 200 provided in the sound converter according to the second embodiment of the present invention, a soldering or welding portion 270' to which a leader wire of a voice coil 140 is to be soldered or welded is provided at the connection portion 230. The conductive pattern 260 provided in the sound converter according to the second embodiment of the present invention is formed up to the central portion 210 of the damper 200. However, if the soldering or welding portion 270' is provided at the connection portion 230 as in the second embodiment, the conductive pattern 260 may be formed up to the soldering or welding portion 270' and may not be formed at the central portion 210.

Figure 9:
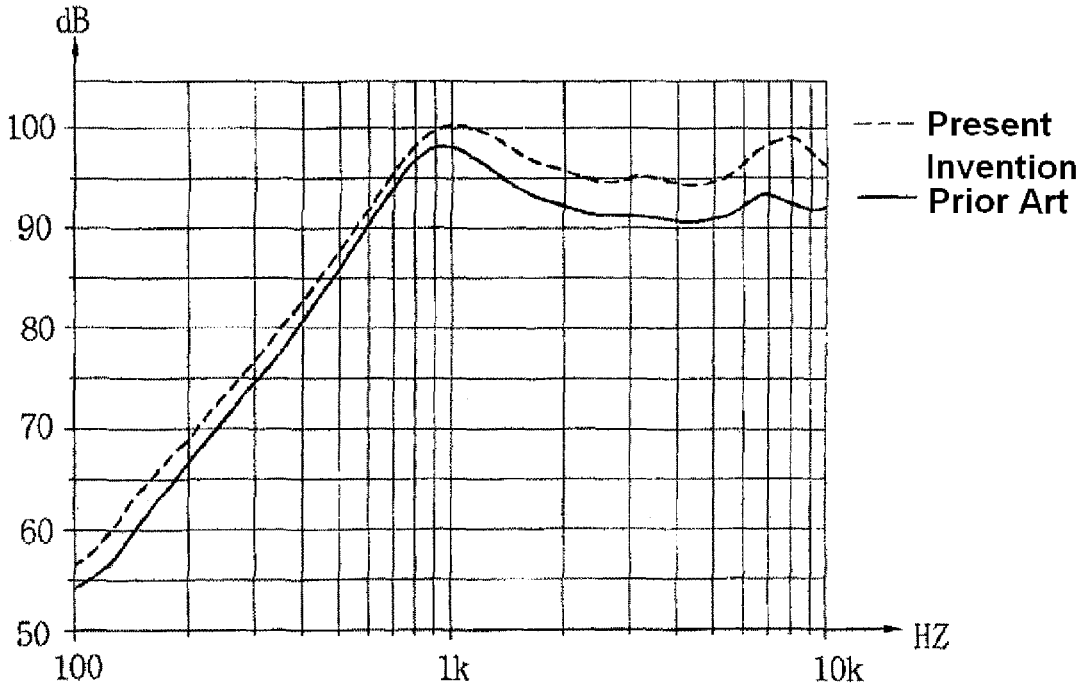
FIG. 9 is a graph showing characteristics of an inventive sound converter versus characteristics of a conventional sound converter having an upward dome.

FIG. 9 is a graph showing characteristics of an inventive sound converter versus characteristics of a conventional sound converter having an upward dome. In comparison, the sound characteristics of the inventive sound converter have been more improved in the whole frequency bands than those of the conventional sound converter.

What is claimed is:

1. A sound converter, comprising:

a frame;

a yoke assembly provided on one side of the frame and provided with a magnet;

a damper having a central portion formed at the center in a certain shape, a seating portion spaced apart from the central portion and seated on the frame, and a connection portion elastically connecting the seating portion to the central portion;

a side diaphragm having an inner circumference portion overlapping with the edge of the central portion of the damper and an outer circumference portion overlapping with the seating portion and seated on the frame, said side diaphragm being attached to lower parts of the central portion and the seating portion of the damper, and said side diaphragm being formed in a dome shape having a central portion more projecting than the inner circumference portion and the outer circumference portion; and a voice coil mounted on the overlapping portion of the inner circumference portion of the side diaphragm and the central portion of the damper, wherein the central portion of the dome shape of the side diaphragm projects to mounting side of the voice coil.

2. The sound converter of claim 1, further comprising a center diaphragm attached to an upper part of the central portion of the damper.

3. The sound converter of claim 2, wherein the center diaphragm projects to the lower side or the upper side.

4. The sound converter of claim 1, wherein the damper has a conductive pattern formed thereon.

5. The sound converter of claim 4, wherein the damper with the conductive pattern formed thereon is a flexible printed circuit board (FPCB).

6. The sound converter of claim 4, wherein a soldering or welding portion is provided at the central portion of the damper to connect a leader wire of the voice coil.

7. The sound converter of claim 6, wherein the soldering or welding portion is positioned on the inside of a voice coil attachment portion.

8. The sound converter of claim 4, wherein a soldering or welding portion is provided at the connection portion of the damper to connect a leader wire of the voice coil.

9. The sound converter of claim 4, wherein the damper comprises an extended portion extending from one side of the seating portion and exposed to the outside of the frame and a terminal portion formed at an end of the extended portion to provide an electrical connection with an external connection terminal.

10. The sound converter of claim 9, wherein the extended portion of the damper is bent along the lateral surface of the frame and attached to the bottom surface of the frame.

11. The sound converter of claim 10, wherein a groove is formed in the frame to guide the extended portion of the damper.

12. The sound converter of claim 10, wherein a projection is formed on the lateral surface of the frame to thermally bond a part of the extended portion.

13. The sound converter of claim 12, wherein a groove is formed in the terminal portion of the damper that corresponds to the thermal bonding projection of the frame.

14. The sound converter of claim 1, wherein the side diaphragm is prepared by laminating a thermoplastic polyurethane (TPU) film and a polyetheretherketone (PEEK) film.

15. The sound converter of claim 1, wherein the voice coil is a lightweight aluminum alloy coil.

16. The sound converter of claim 1, further comprising a protector provided over at least the side diaphragm for protecting the side diaphragm.

* * * * *